US009266032B2

(12) United States Patent
Haughey et al.

(10) Patent No.: US 9,266,032 B2
(45) Date of Patent: Feb. 23, 2016

(54) MAGNETIC BLOCKS AND METHOD OF MAKING MAGNETIC BLOCKS

(71) Applicant: Clipper Investment Holdings Ltd., Tortola (VG)

(72) Inventors: Christopher Harwood Haughey, Los Angeles, CA (US); William Harcourt Haughey, Rowayton, CT (US); William Joseph Delisle, Mountain View, CA (US)

(73) Assignee: Clipper Investment Holdings Ltd., Tortola (VG)

( * ) Notice: Subject to any disclaimer, the term of this patent is extended or adjusted under 35 U.S.C. 154(b) by 0 days.

(21) Appl. No.: 14/490,138

(22) Filed: Sep. 18, 2014

(65) Prior Publication Data

US 2015/0004870 A1 Jan. 1, 2015

Related U.S. Application Data

(62) Division of application No. 12/412,049, filed on Mar. 26, 2009, now Pat. No. 8,850,683.

(51) Int. Cl.
*A63H 33/04* (2006.01)

(52) U.S. Cl.
CPC ..... *A63H 33/046* (2013.01); *Y10T 29/49826* (2015.01)

(58) Field of Classification Search
USPC ..... 446/92, 122, 123, 124, 127, 131, 137, 446/138; 29/428; 273/156, 288
See application file for complete search history.

(56) References Cited

U.S. PATENT DOCUMENTS

| | | | |
|---|---|---|---|
| 1,142,471 | A | 6/1915 | White |
| 1,216,840 | A | 2/1917 | Ramsey et al. |
| 1,236,234 | A | 8/1917 | Troje |
| 1,472,536 | A | 10/1923 | Thomson |
| 2,199,818 | A | 5/1940 | Franke |
| 2,254,498 | A | 9/1941 | Scharf |
| 2,277,057 | A | 3/1942 | Bach |
| 2,465,971 | A | 3/1949 | Leblang |
| 2,474,365 | A | 6/1949 | Munn |
| 2,570,625 | A | 10/1951 | Zimmerman et al. |
| 2,795,893 | A | 6/1957 | Vayo |
| 2,872,754 | A | 2/1959 | Cronberger |
| 2,939,243 | A | 6/1960 | Duggar |
| 3,095,668 | A | 7/1963 | Dorsett |
| 3,102,362 | A | 9/1963 | Neal |
| 3,184,882 | A | 5/1965 | Vega |
| 3,196,579 | A | 7/1965 | Lepper |
| 3,210,080 | A | 10/1965 | Rael et al. |

(Continued)

FOREIGN PATENT DOCUMENTS

| | | |
|---|---|---|
| EP | 1559464 | 8/2005 |
| JP | 3-176103 | 7/1991 |

(Continued)

*Primary Examiner* — Kurt Fernstrom
(74) *Attorney, Agent, or Firm* — Mitchell Intellectual Property Law, PLLC

(57) ABSTRACT

Toy blocks with internally disposed magnets, and methods of making same. Pockets for the magnets are machined into a non-extrudable material such as wood. Strong permanent magnets are disposed in the pockets to cause the faces of the block to exhibit a desired polarity magnetic field. The pockets are then sealed to permanently retain the magnets. The exterior shape of the block may be formed either prior to or subsequent to machining and sealing of the pockets.

9 Claims, 6 Drawing Sheets

(56) References Cited

U.S. PATENT DOCUMENTS

| | | | | | |
|---|---|---|---|---|---|
| 3,254,440 | A | * | 6/1966 | Duggar | 446/92 |
| 3,407,530 | A | | 10/1968 | Grant et al. | |
| 3,601,921 | A | | 8/1971 | Strohmaier | |
| 3,672,681 | A | | 6/1972 | Wolf | |
| 3,714,612 | A | | 1/1973 | Kayle | |
| 4,026,086 | A | | 5/1977 | Langley | |
| 4,194,737 | A | | 3/1980 | Farmer | |
| 4,238,905 | A | | 12/1980 | MacGraw | |
| 4,258,479 | A | | 3/1981 | Roane | |
| 4,389,808 | A | | 6/1983 | Podell et al. | |
| 4,462,596 | A | | 7/1984 | Yamamoto | |
| 4,647,891 | A | | 3/1987 | Hughes | |
| 4,886,273 | A | | 12/1989 | Unger | |
| 4,986,539 | A | | 1/1991 | Jackson | |
| 5,013,245 | A | | 5/1991 | Benedict | |
| 5,127,652 | A | | 7/1992 | Unger | |
| 5,347,253 | A | * | 9/1994 | Ogikubo | 335/302 |
| 5,409,236 | A | | 4/1995 | Therrien | |
| 5,411,262 | A | | 5/1995 | Smith | |
| 5,520,396 | A | | 5/1996 | Therrien | |
| 5,566,949 | A | | 10/1996 | Gorden | |
| 5,746,638 | A | | 5/1998 | Shiraishi | |
| 5,810,602 | A | | 9/1998 | Menelly | |
| 5,921,781 | A | | 7/1999 | Shaw | |
| 6,024,626 | A | * | 2/2000 | Mendelsohn | 446/92 |
| 6,030,303 | A | | 2/2000 | Wallace, Jr. | |
| 6,062,937 | A | | 5/2000 | Kikuchi | |
| 6,241,249 | B1 | | 6/2001 | Wang | |
| 6,322,414 | B1 | | 11/2001 | Lin | |
| 6,431,936 | B1 | | 8/2002 | Kiribuchi | |
| 6,450,853 | B1 | | 9/2002 | Larws | |
| 6,482,063 | B1 | | 11/2002 | Frigard | |
| 6,645,032 | B2 | | 11/2003 | Barringer et al. | |
| 6,749,480 | B1 | | 6/2004 | Hunts | |
| 6,790,118 | B2 | | 9/2004 | Ahn | |
| 6,893,315 | B2 | | 5/2005 | Barri | |
| 6,969,294 | B2 | | 11/2005 | Vicentelli | |
| 7,066,778 | B2 | | 6/2006 | Kretzschmar | |
| 7,154,363 | B2 | | 12/2006 | Hunts | |
| 7,160,170 | B2 | | 1/2007 | Yoon | |
| 7,191,571 | B2 | | 3/2007 | Schools et al. | |
| 7,255,624 | B2 | | 8/2007 | Daftari | |
| 7,273,404 | B2 | | 9/2007 | Kowalski | |
| 7,320,633 | B2 | | 1/2008 | Park | |
| 7,371,147 | B2 | | 5/2008 | Tusacciu | |
| 7,413,493 | B2 | | 8/2008 | Toht | |
| 7,507,136 | B2 | | 3/2009 | Patton | |
| 7,758,398 | B2 | | 7/2010 | Park | |
| 7,887,056 | B2 | | 2/2011 | Tenorio | |
| 7,892,065 | B2 | | 2/2011 | Vicentelli | |
| 7,955,156 | B2 | | 6/2011 | Toht et al. | |
| 7,967,656 | B2 | | 6/2011 | Hu | |
| 7,985,116 | B2 | | 7/2011 | Song et al. | |
| 7,988,518 | B2 | * | 8/2011 | Kim et al. | 446/92 |
| 8,016,635 | B2 | | 9/2011 | Park | |
| 8,016,636 | B2 | | 9/2011 | Park | |
| 8,070,550 | B2 | | 12/2011 | Song et al. | |
| 8,100,735 | B2 | | 1/2012 | Park | |
| 8,348,279 | B2 | | 1/2013 | Burton | |
| 8,382,548 | B2 | | 2/2013 | Maggiore et al. | |
| 8,458,863 | B2 | * | 6/2013 | Hunts | 24/303 |
| 2004/0000114 | A1 | | 1/2004 | Schools et al. | |
| 2004/0043164 | A1 | | 3/2004 | Vicentelli | |
| 2005/0009438 | A1 | * | 1/2005 | Chojnacki et al. | 446/120 |
| 2005/0159076 | A1 | | 7/2005 | Kowalski et al. | |
| 2005/0164595 | A1 | | 7/2005 | Toht et al. | |
| 2005/0170739 | A1 | | 8/2005 | Zoellner | |
| 2006/0084300 | A1 | | 4/2006 | Kowalski et al. | |
| 2006/0111010 | A1 | | 5/2006 | Park | |
| 2006/0139134 | A1 | | 6/2006 | Hunts | |
| 2006/0240737 | A1 | | 10/2006 | Yoon | |
| 2007/0037469 | A1 | | 2/2007 | Yoon | |
| 2007/0287353 | A1 | | 12/2007 | Vicentelli | |
| 2008/0113579 | A1 | | 5/2008 | Park | |
| 2008/0139077 | A1 | | 6/2008 | Patton | |
| 2008/0200091 | A1 | | 8/2008 | Blaivas | |
| 2008/0305708 | A1 | | 12/2008 | Toht et al. | |
| 2009/0239441 | A1 | | 9/2009 | Hu | |
| 2010/0022158 | A1 | | 1/2010 | Kim | |
| 2010/0056013 | A1 | | 3/2010 | Kaplan | |
| 2010/0075567 | A1 | | 3/2010 | Kim | |
| 2010/0120322 | A1 | | 5/2010 | Vicentelli | |
| 2010/0173560 | A1 | | 7/2010 | Park | |
| 2010/0184351 | A1 | | 7/2010 | Park | |
| 2010/0242250 | A1 | | 9/2010 | Haughey et al. | |
| 2010/0255750 | A1 | | 10/2010 | Park | |
| 2012/0309259 | A1 | | 12/2012 | Mak | |
| 2012/0322339 | A1 | | 12/2012 | Kim et al. | |
| 2013/0095722 | A1 | | 4/2013 | Cochella | |

FOREIGN PATENT DOCUMENTS

| | | |
|---|---|---|
| JP | 3052774 | 10/1998 |
| JP | 2006-341065 | 12/2006 |
| JP | 2010-234050 | 10/2010 |
| KR | 200263127 | 1/2002 |
| WO | 2004/062760 | 7/2004 |
| WO | 2008/069549 | 6/2008 |
| WO | 2009/154315 | 12/2009 |

* cited by examiner

MAGNETIC BLOCKS AND METHOD OF MAKING MAGNETIC BLOCKS

CROSS REFERENCE TO RELATED APPLICATION

This is a divisional of parent U.S. patent application Ser. No. 12/412,049, filed Mar. 26, 2009, and entitled MAGNETIC BLOCKS AND METHOD OF MAKING MAGNETIC BLOCKS.

BACKGROUND

1. Field of the Invention

Embodiments of the invention relate to wooden blocks. More specifically, embodiments of the invention relate to wooden blocks having internally disposed permanent magnets.

2. Background

Blocks are one of the quintessential toys that have been around for generations. Over the years, blocks have been made of wood, various plastics, and assorted other materials. Traditional blocks are merely geometric shapes that can be stacked or arranged to build things without any real interconnection between the blocks. These traditional blocks rely on influence of gravity to maintain a position within the structure. Many structures are impossible to build with such blocks. Other block-like toys, such as LEGO® have a mechanical interconnection which allows user to build more complex structures. To address some of the limitations of blocks, efforts have been made to introduce magnets into blocks so that magnetic coupling is possible between adjacent blocks in a structure. Introduction of these magnets is relatively simple and cost effective where underlying material used is extrudable, such as in the context of plastic blocks. However, in this case of non-extrudable materials, such as wood, the techniques used with extrudable materials do not apply.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
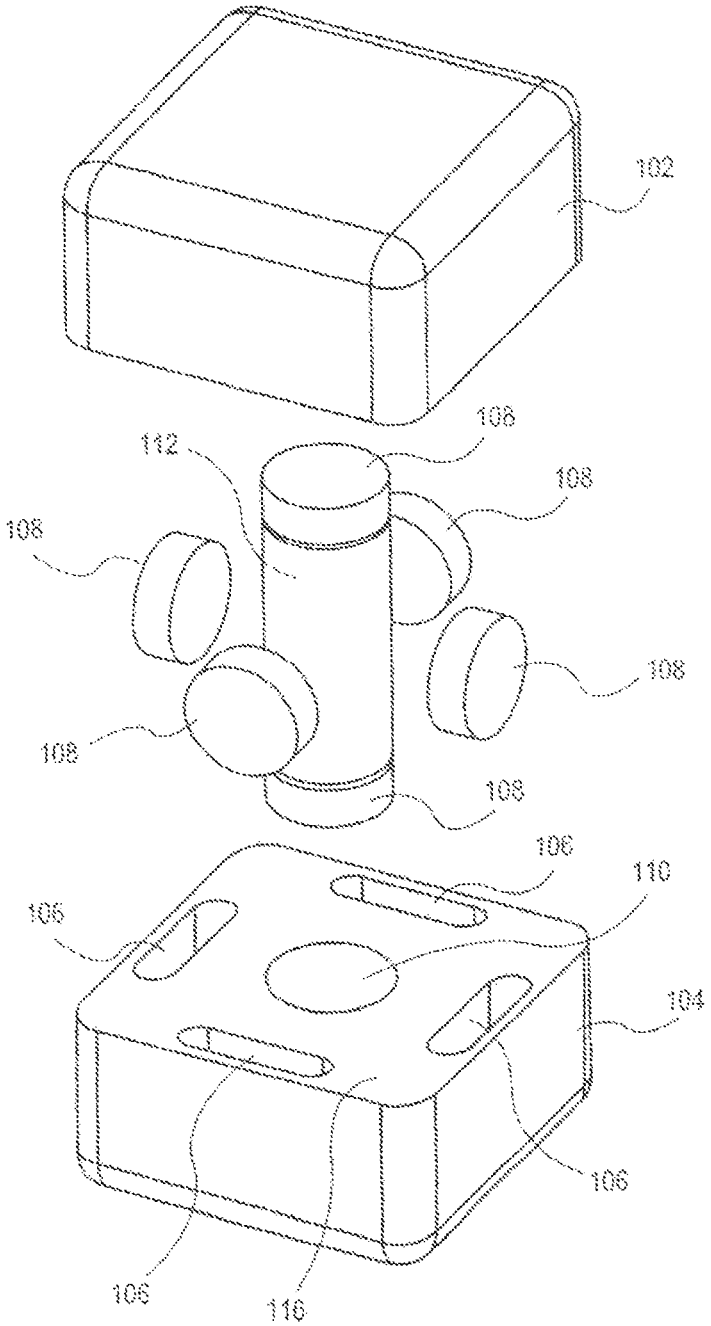
FIG. 1 is an exploded view of a block made in accordance with one embodiment of the invention.

FIG. 1 is an exploded view of a block made in accordance with one embodiment of the invention. In FIG. 1, the ultimate geometric shape is a cube with rounded edges, which is formed as a first half 102 and a second half 104. The first half 102 and second half 104 may be formed individually or in groups from a substrate as described below. Hard wood is a preferred material for manufacture. Wood has a warmth and tactile response that is not attainable in extrudable synthetics. But its non-extrudable nature renders it more challenging from a manufacturing standpoint.

Pockets 106 are defined in both the top half 102 and the bottom half 104 to receive magnets 108 and hold them internally adjacent to the side faces of the cube. A central bore 110 in each of the top and bottom halves 102, 104 defines a pocket to receive magnets 108 internally proximate to the top and bottom faces of the cube. A spacer such as dowel 112 retains top and bottom magnets 108 proximate to the respective external surface. While the spacer is shown as a cylinder other shapes of spacers may be used.

By appropriately orienting magnets 108 inserted into pockets 106 and bore 110, the polarity exhibited by each face of the cube can be controlled. It is generally believed to be desirable to have an equal number of north pole faces and south pole faces on a particular block. But, some embodiment of the invention may have different polar organization such as four north and two south, or vice versa. There may even be cases where a particular block is nonpolar, i.e., all faces exhibit either a north pole or a south pole.

Top half 102 and bottom half 104 may be coupled together along interface surface 116. In one embodiment, an adhesive such as wood glue may be used to achieve the coupling. Because of the relatively large surface area of interface surface 116, strong adhesion occurs and disassembly of the blocks is less likely. Particularly in the context of toys for children, disassembly is highly undesirable as the magnets and other small parts may then represent a choking hazard. It is preferred to use wood glue that is approved for indirect food contact such as Titebond II and Titebond III commercially available. By appropriately grain matching the source of the top half 102 and bottom half 104, the line of adhesion can be rendered nearly imperceptible.

Magnets 108 may be rare earth magnets that generate a magnetic field in the range of 10,000 to 13,500 gauss. For example, magnets 108 may be Neodymium Iron Boron (NdFeB) magnets, which have an exceedingly strong attraction to one another and to other ferromagnetic objects, subject to factors such as the size and shape of the magnets and their relative orientation and proximity to one another and/or other ferromagnetic objects. N40 grade cylindrical magnets ⅛ inch thick and ⅜ inch in diameter have been found suitable for blocks having a 30 mm side. Larger size blocks may make a stronger magnet desirable. Stronger attraction may be achieved with larger or higher grade magnets. The strong magnetic connections between the blocks allow for the construction of structures which are impossible to sustain with normal, non-magnetic blocks. Additionally, the strong forces generated between the blocks (both attraction and repulsion, depending on relative orientation) are surprising and delighting to children and adults, given the hidden nature of the magnets within the blocks (fully encased). Depending on the base material used in the block structure itself, the look, feel and sound of the blocks "clicking" or "clacking" when they come together rapidly as a result of the magnetic attraction is attractive and makes for an enjoyable play experience. When two blocks are placed near one another on a surface or in space, the blocks will sometimes move or spin, seemingly of their own accord, as the magnets 108 within them attract and/or repel one another, creating an apparently "magical" phenomenon.

Figure 2:
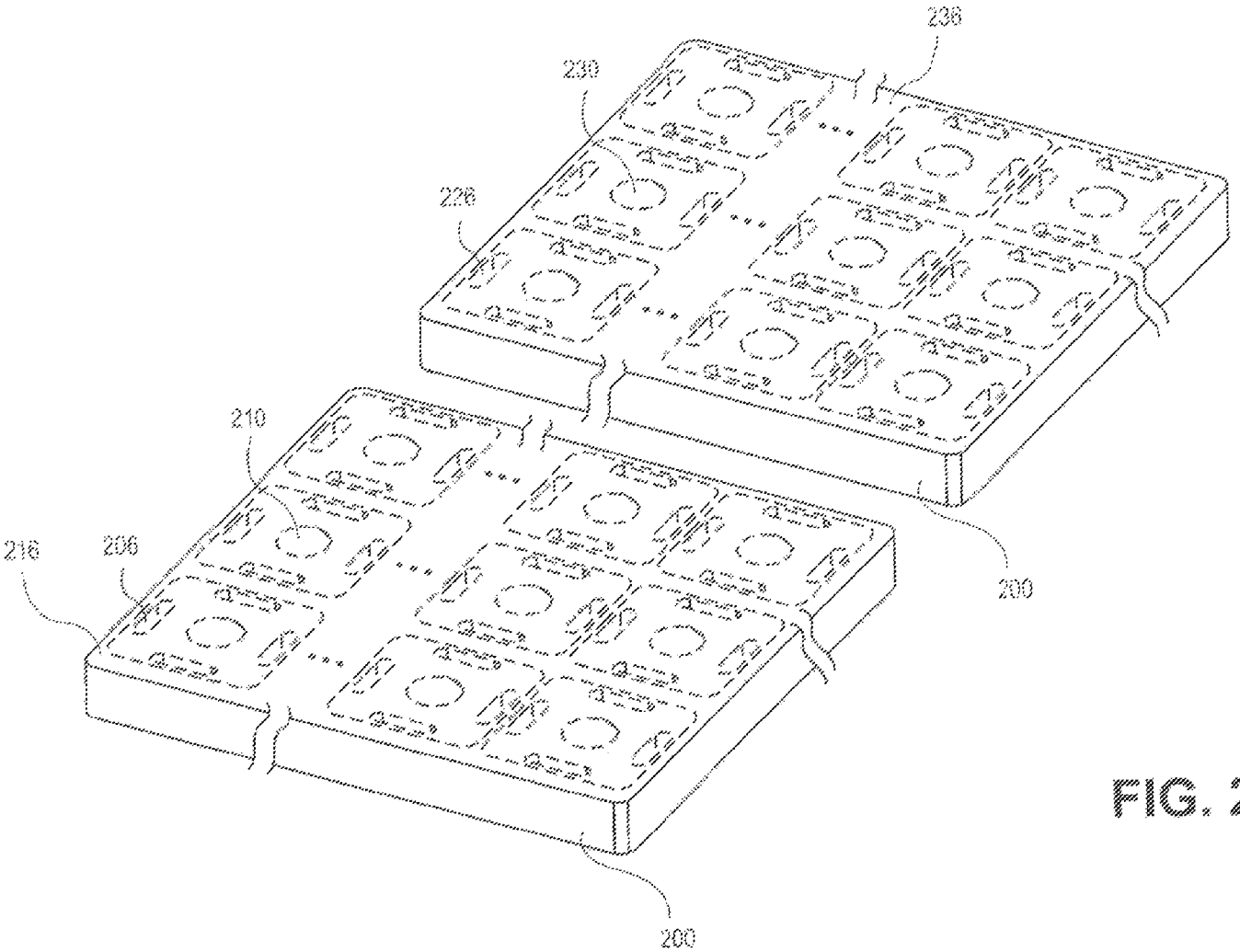
FIG. 2 is a schematic diagram of multiple block halves created in a pair of substrates according to one embodiment of the present invention.

FIG. 2 is a schematic diagram of multiple block halves created in a pair of substrates according to one embodiment of the present invention. The ultimate desired shape may be defined within a computer. The machining of a substrate such as boards 200 and board 220 is computer-driven. The machining forms pockets 206 and central bore 210 for a plurality of halves 202. Boards 200 and 220 may permit an arbitrarily large array of halves to be machined therein. In some embodiments, depending on the size of the boards 200, 220 and the size of the ultimate desired shape, the array may be two dimensional or one dimensional.

For economic reasons it is desirable to minimize the space between the halves along the board and therefore the sacrificial or waste product when the ultimate geometric shape is separated from the rest. By selecting two boards 200 and 220 having closely matching grain (also referred to as grain matching), the interface between halves can be hidden. Since the grain of both substrates matches a second set of halves can be machined to have corresponding pocket 226 and bore 230 in board 220 which will couple to the first set shown in FIG. 2 by gluing the boards 200, 220 together. The magnets inserted into pockets 206 and a spacer inserted into bore 210 help to align the respective boards 200,220 which can be glued together along their length so that a solid adhesion exist between contact areas 216 and 236. The individual desired shapes may then be separated with either standard or computer-driven tooling. While the description above refers to "halves" it is not strictly necessary that the two pieces that form the final block be identical or symmetric. But symmetry does simplify tooling.

Figure 3A:
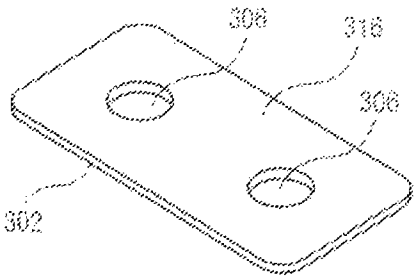
FIGS. 3A-3C are views of one half of an alternative block that may be produced in accordance with one embodiment of the invention.
Figure 3B:
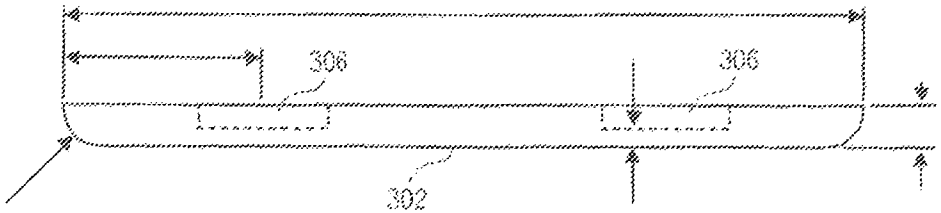
Figure 3C:
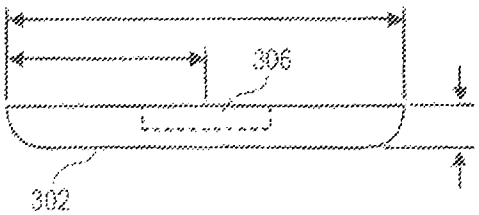

FIGS. 3A-3C are views of one half of an alternative block that may be produced in accordance with one embodiment of the invention. FIG. 3A is an isometric view showing half 302 which has defined therein two pockets 306 and an interface surface 316. Plural halves can be defined and machined into a single substrate as described with reference to FIG. 2. FIG. 3B shows a side view of half 302 with pockets 306 shown in phantom lines. Pockets 306 are defined to accept a suitable magnet. While pockets 306 are shown as circular and therefore accepting a cylindrical magnet, rectangular pockets or any other shaped pocket could also be defined. It is desirable that the magnet fits snugly within the pocket so as not to rattle around during use. Block 302 is defined to be twice the length of a cube face such as the cubes of FIG. 1 and may be used as a spacer in construction projects. Half 302, in one embodiment, has a thickness of 3 mm and a 3 mm radius curvature at the edges. FIG. 3C shows an end view of block half 302. While half 302 is shown to be 60 mm long other shapes and dimensions of blocks made in an analogous manner are envisioned. For example, block half 302 could be any integer number of cube faces in length, for example, 90 mm, 120 mm, etc. where the cube face is 30 mm across. It is also envisioned that the number of magnet pockets defined may or may not increase with length. For example, a 90 mm plank may have three magnets or only two.

Figure 4:
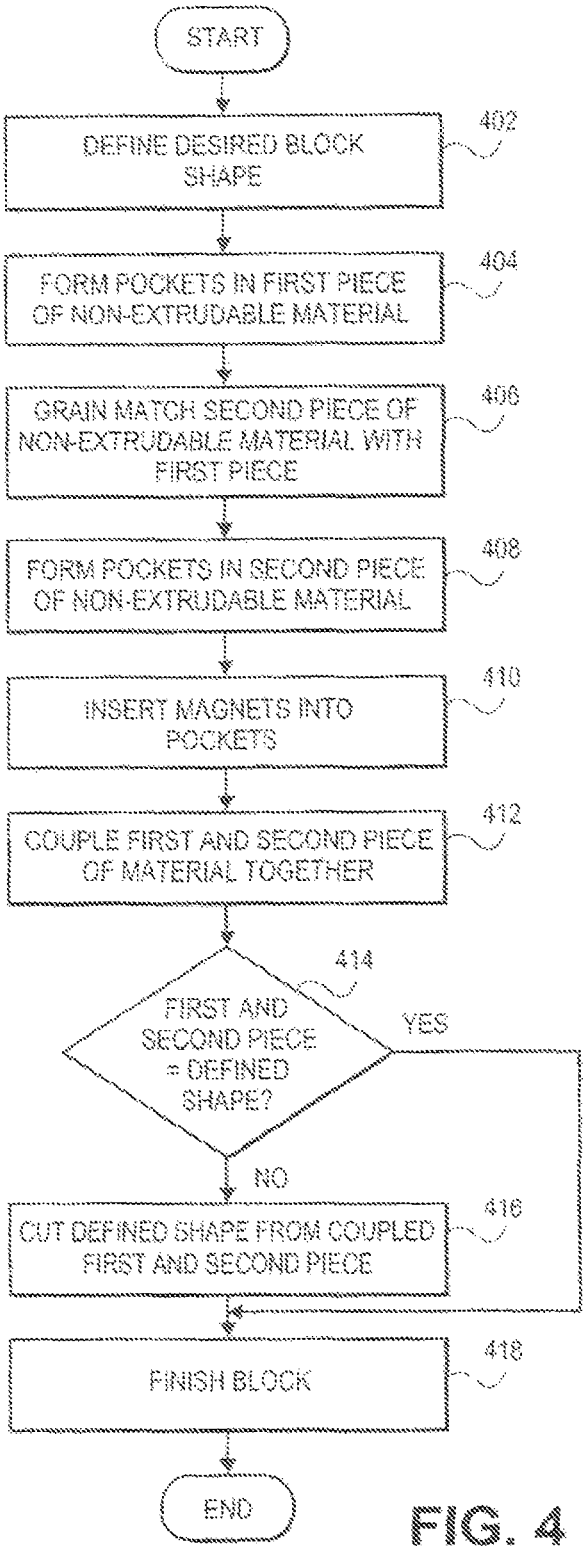
FIG. 4 is a flow diagram of a process of making blocks in accordance with one embodiment of the invention.

FIG. 4 is a flow diagram of a process of making blocks in accordance with one embodiment of the invention. At box 402, the desired block shape is defined. Definition may take the form of a computer file which then may be used to drive the subsequent machining of the block from a substrate. In other embodiments, the ultimately desired geometric shape may be formed at the definition stage and the processed individually as described below.

At box 404, pockets are formed in a first piece of non-extrudable material. These pockets may correspond to, for example, pockets 306 as shown in FIG. 3A or pockets 106 and bore 110 as shown in FIG. 1. By forming the pockets sized to snugly hold the magnets rattling of the finished block may be avoided. Alternatively the magnets may be adhered within the pockets. At box 406, the second piece of non-extrudable material is grain-matched with the first piece. With grain-matching, once the first and second pieces of material are coupled together to form the ultimate desired shape, a visual distinction between the pieces may be rendered substantially imperceptible (the block visually appears to be formed from one solid piece of material). At box 408, pockets are formed in a second piece of non-extrudable material. Such pockets correspond to the pockets formed in the first piece at box 404 such that the two pieces in conjunction form all or a greater part of the desired geometric shape.

At box 410, magnets are inserted into respective pockets such that a desired polarity is exhibited by the corresponding adjacent face. As noted above, in some embodiments, the magnets may be adhered to the pocket to prevent movement of the magnet within the pocket. In some embodiments, it is desired to ensure that there are an equal number of faces of each polarity. At box 412, the first and second pieces of non-extrudable material are coupled together sealing the pockets and permanently encapsulating the magnets. In one embodiment, this coupling is the result of adhesion with the use of, for example, wood glue.

Box 414 is an implicit decision whether the desired block has been made individually such as where the desired block shape is rendered at definition box 402 or if the block is defined as part of, for example, a pair of larger substrates (as discussed with reference to FIG. 2). If the block is not yet rendered, the defined shape is cut from the first and second pieces of material after they are coupled together, at block 416. Once the desired block shape is obtained, the block may be finished at 418. In some embodiments, finishing may include any of sanding, staining and varnishing or otherwise coating the block.

Figure 5:
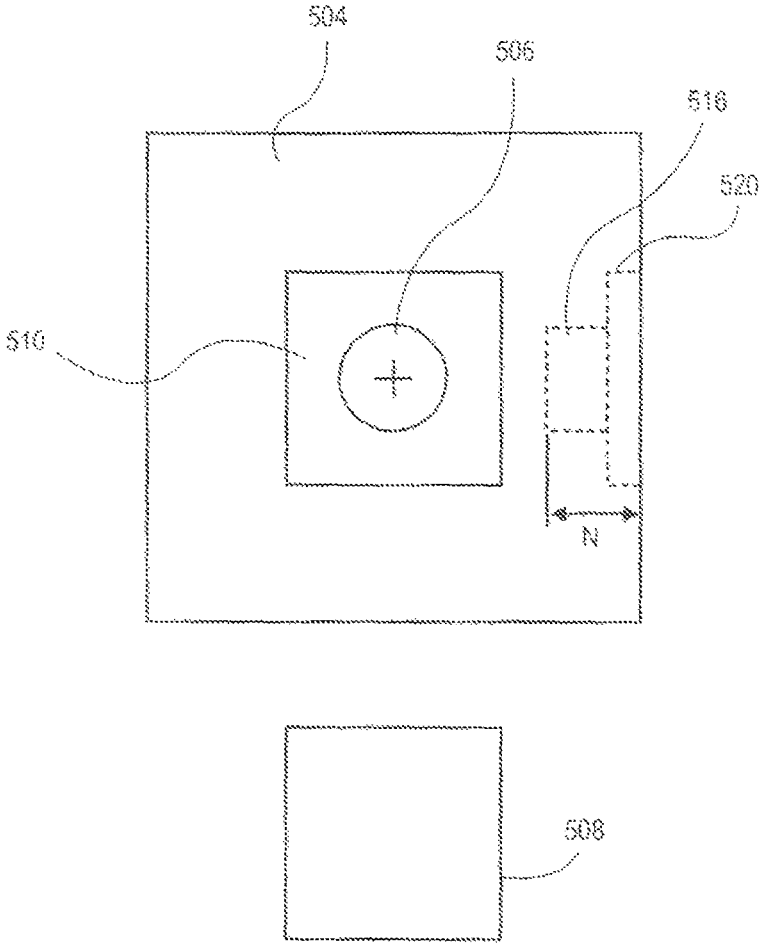
FIG. 5 is a diagram of a block produced in accordance with one embodiment of the invention.

FIG. 5 is a diagram of a block produced in accordance with one embodiment of the invention. A pocket is formed in each face by boring to a depth N at approximately the face center. Additional material is machined from area 510 to a depth of N minus the magnet thickness. Plug 508 is then used to overlay the magnet 506 deposited within the pocket. Because the adhesion surface 510 is relatively large, the risk of disassembly is reduced, in contrast to a case where only the edges of a plug having the same dimensions as the magnet were used. Such edge-only adhesion has been found to be unsuitable for strong permanent magnets as used here. While plug 508 is shown as rectangular, area 510 can be formed in any shape and therefore plug 508 could be formed in any shape. What is important is that the adhesive surface area over match the magnetic force so that the plug does not dislodge during normal use.

Figure 6:
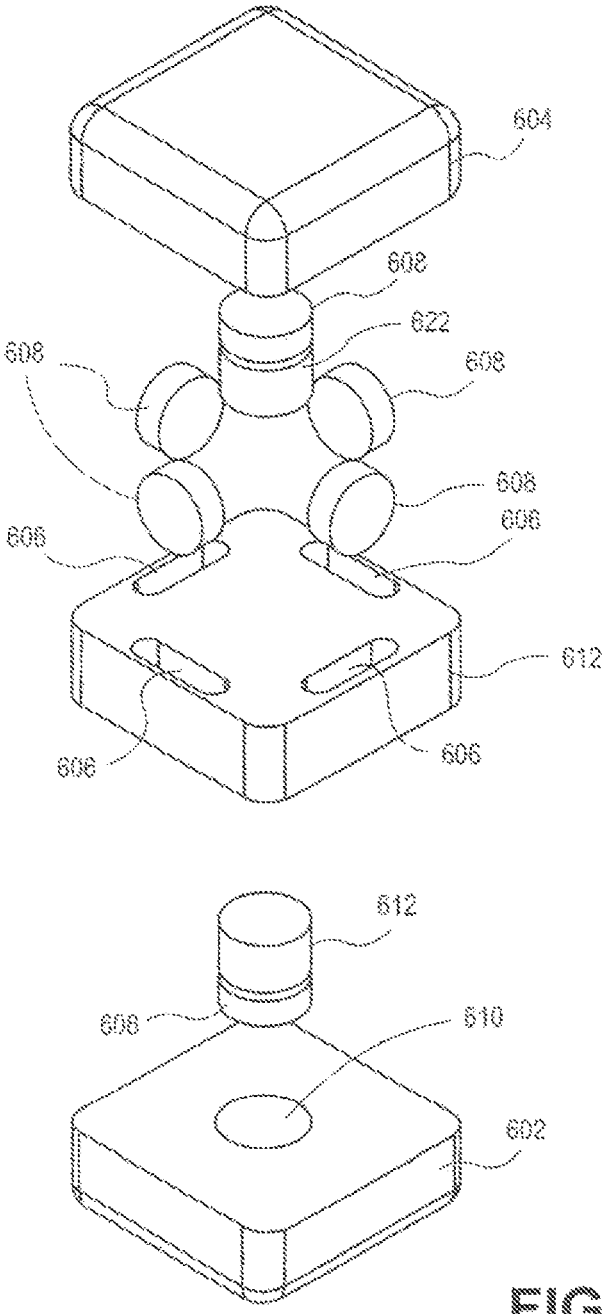
FIG. 6 is a diagram of a block formed in accordance with another embodiment of the invention.

FIG. 6 is a diagram of a block formed in accordance with another embodiment of the invention. In this example, the cube is formed of three pieces, top piece 604, bottom piece 602 and a middle layer 612. The pockets for the top and bottom are formed as a bore 610 in bottom piece 602 and top piece 604, respectively. Pockets 606 for the side face magnets are formed in middle layer 612. The top 604 and bottom 602 portions then sandwich the middle layer 612. A spacer 622 and 632 retain the bottom and top magnets 608 proximate to their respective faces. It should be understood that this embodiment can be produced in the same manner as described with reference to FIG. 4 and FIG. 2.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. A toy block comprising:

first and second solid block parts, each having at least one interior face;

said first part including at least three exterior facing sides;

said first part including at least one pocket extending downwardly from said interior face, into said first part, in close proximity and parallel to, but spaced inwardly from, one of said exterior facing sides, and including a magnet disposed in said pocket with its north or south face oriented so as to project its north or south magnetic field outwardly through and from said side;

said second part of said block being coupled to said first part of said block with said interior faces facing inwardly toward one another, totally enclosing and concealing said magnets and said pockets;

said first block part also having an externally facing bottom face;

a bore extending downwardly into said first part from said interior face and terminating in close proximity to but spaced from said externally facing bottom face;

a magnet located at the terminus of said bore with its north or south face oriented so that its north or south magnetic field projects outwardly through said bottom face.

2. The toy block of claim 1 wherein said magnets comprise: cylindrical NdFeB magnets.

3. A toy block comprising:

first and second solid block parts, each having at least one interior face;

said first art including at least three exterior facing sides;

said first part including at least one slot extending from said interior face into said first block part proximate and parallel to, but spaced inwardly from, one of said external side faces, and including a disk magnet disposed in said slot with its north or south face oriented so as to project its north or south magnetic field outwardly through and from said side;

said second block part includes external side faces corresponding to said external side faces on said first block part; there being a slot in said second block part oriented to mate with each said slot in said first block part when said first and second block parts are coupled; each said second part slot extending from said second part interior face into said second block part proximate and parallel to one of said external side faces; said slots in said first block part having a depth accommodating only a portion of the diameter of said disc magnet, said disc magnet being located partly in said first part slot and partly in said second part slot;

said first and second block parts including a bottom face and a top face, respectively, opposite their mating interior faces; a central bore in each said first and second block part extending from its said interior face towards, and terminating internally proximate to and parallel to, its opposite bottom external face or top external face, respectively;

there being a disc shaped magnet in each said central bore of said first and second block parts, at the terminus of each said bore, parallel to its said bottom or top external face, respectively; said second part of said block being coupled to said first part of said block with said interior faces facing inwardly toward one another, totally enclosing and concealing said magnets and said slots and said bores.

4. A toy block comprising:

first and second solid block parts, each having at least one interior face;

said first part including at least three exterior facing sides;

said first part including at least one pocket extending downwardly from said interior face, into said first part, in close proximity and parallel to, but spaced inwardly from, one of said exterior facing sides, and including a magnet disposed in said pocket with its north or south face oriented so as to project its north or south magnetic field outwardly through and from said side;

said second part of said block being coupled to said first pan of said block with said interior faces facing inwardly toward one another, totally enclosing and concealing said magnets and said pockets;

a third separate solid block part coupled to said first block pan, said third separate solid block part having at least one interior face, and said first block part having a second internal face opposite said first block part at least on interior face; said third block part interior face facing said second interior face of said first block part;

said second and third block pans defining a top external face and a bottom external face on said block, each said top and bottom external face being located opposite its respective block part interior face;

a bore in said second block part, extending from said interior face towards said top external face, said bore terminating internally proximate to and parallel to said top external face;

a disc shaped magnet being positioned at the terminus of said bore, parallel to said top external face;

a bore in said third block part extending from said interior face towards said bottom external face, said bore terminating internally proximate to and parallel to said bottom external face;

a disc shaped magnet being positioned at the terminus of said bore, parallel to said bottom external face.

5. The toy block of claim 4 wherein said first block part includes a plurality of said pockets, one for each of said external sides, and each said pocket extending downwardly from said interior face, into said first part, in close proximity and parallel to, but spaced inwardly from, its respective exterior facing sides;

there being one of said magnets in each of said pockets internally proximate to their corresponding external side faces.

6. The toy block of claim 5 wherein each said pocket comprises a slot extending from said interior face into said first block part proximate and parallel to said external side face; each of said magnets being disc shaped magnets.

7. The toy block of claim 6 in which there are an even number of said side faces on said first block parts; said disc magnets in said slots being positioned in a polarity orientation such that an aggregate number of north poles internally proximate to their corresponding external side faces is equal to an aggregate number of south poles; said magnets in said bores being oriented such that they project opposite poles through said top and bottom faces.

8. A toy block comprising:

first and second separate solid block parts, each having at least one interior face, said first and second solid block parts being coupled together with said interior faces facing inwardly toward one another;

said first block part having a bottom face opposite its interior face and said second block part having a top face opposite its interior face;

said first and second block parts each having at least three corresponding external side faces, the corresponding side faces on said first and second blocks being aligned with one another;

each said first and second block parts having a slot adjacent each of said external side faces, extending from said interior face of its respective first or second block part, into said block part proximate and parallel to its adjacent external side face; each said slot having a depth accommodating only a portion of the diameter of a disc magnet located therein, said slots in said first and second block parts mating with each other to create a magnet accommodating slot;

there being a disc magnet in each said mating set of slots;

a central bore in each said first and second block part extending from its said interior face towards, and terminating internally proximate to and parallel to, its opposite bottom external face or top external face, respectively;

there being a disc shaped magnet in each said central bore of said first and second block parts, at the terminus of each said bore, parallel to its said bottom or top external face, respectively.

9. The toy block of claim 8 in which there are an even number of said side faces on said first and second block parts; said disc magnets which are in said mating sets of slots being positioned in a polarity orientation such that an aggregate number of north poles internally proximate to their corresponding external side faces is equal to an aggregate number of south poles; said magnets in said bores being oriented such that they project opposite poles through said top and bottom faces.

* * * * *